US006364112B1

(12) United States Patent
Pitschka

(10) Patent No.: US 6,364,112 B1
(45) Date of Patent: Apr. 2, 2002

(54) CONDIMENT CONTAINER FOR ATTACHING TO OTHER OBJECTS

(75) Inventor: Alex Pitschka, Los Angles, CA (US)

(73) Assignee: Dashboard Packaging Joint Venture, San Francisco, CA (US)

( * ) Notice: Subject to any disclaimer, the term of this patent is extended or adjusted under 35 U.S.C. 154(b) by 0 days.

(21) Appl. No.: 09/432,665

(22) Filed: Nov. 3, 1999

(51) Int. Cl.[7] ..... B65D 73/00

(52) U.S. Cl. ..... 206/460; 206/806; 224/483; 224/901.8

(58) Field of Search ..... 206/216, 460, 206/806, 901.8; 224/901.8, 483; 220/476, 480, 481, 751; 383/11

(56) References Cited

U.S. PATENT DOCUMENTS

| | | | | | |
|---|---|---|---|---|---|
| 1,606,944 | A | * | 11/1926 | Johnson | 206/806 |
| 3,109,578 | A | * | 11/1963 | Davis | 383/11 |
| 3,155,282 | A | * | 11/1964 | Leblanc | 206/484 |
| 3,508,700 | A | * | 4/1970 | Kelly | 383/11 |
| 4,004,397 | A | | 1/1977 | Hoffman et al. | |
| 4,339,033 | A | | 7/1982 | Cillario | |
| 4,491,220 | A | | 1/1985 | Daviss | |
| 4,854,466 | A | | 8/1989 | Lane, Jr. | |
| 5,181,555 | A | * | 1/1993 | Chruniak | 383/11 |
| 5,335,996 | A | | 8/1994 | Cortopassi et al. | |
| 5,429,262 | A | | 7/1995 | Sharkey | |
| 5,630,544 | A | * | 5/1997 | Shane | 229/117.06 |
| 5,667,119 | A | | 9/1997 | Florence | |
| 5,676,990 | A | | 10/1997 | Wawrzynski | |
| 5,960,947 | A | * | 10/1999 | Dimelis et al. | 206/216 |
| 5,960,973 | A | * | 10/1999 | Markson | 215/386 |
| 6,076,700 | A | * | 6/2000 | Manges | 220/751 |

FOREIGN PATENT DOCUMENTS

| | | | | |
|---|---|---|---|---|
| DE | 1756692 | * | 4/1970 | 383/11 |
| GB | 2250975 | * | 6/1992 | 383/11 |

* cited by examiner

*Primary Examiner*—David T. Fidei
(74) *Attorney, Agent, or Firm*—Stattler Johansen & Adeli, LLP

(57) ABSTRACT

The invention is a condiment container that attaches to other objects. In one embodiment of the invention, the condiment container is a portable and disposable container that adhesively attaches to the interior of a vehicle. This embodiment facilitates the eating of food and snacks while driving. This embodiment includes a container body that holds the condiment. The container body can have any shape (e.g., it can be in a shape of a packet or a bucket). This container includes an attaching arm that rotatably couples to the container body, and has an adhesive material on one of its sides. A consumer can attach the container to a surface in the vehicle by rotating the arm away from the container body and abutting the adhesive side of the arm to the vehicle surface.

8 Claims, 5 Drawing Sheets

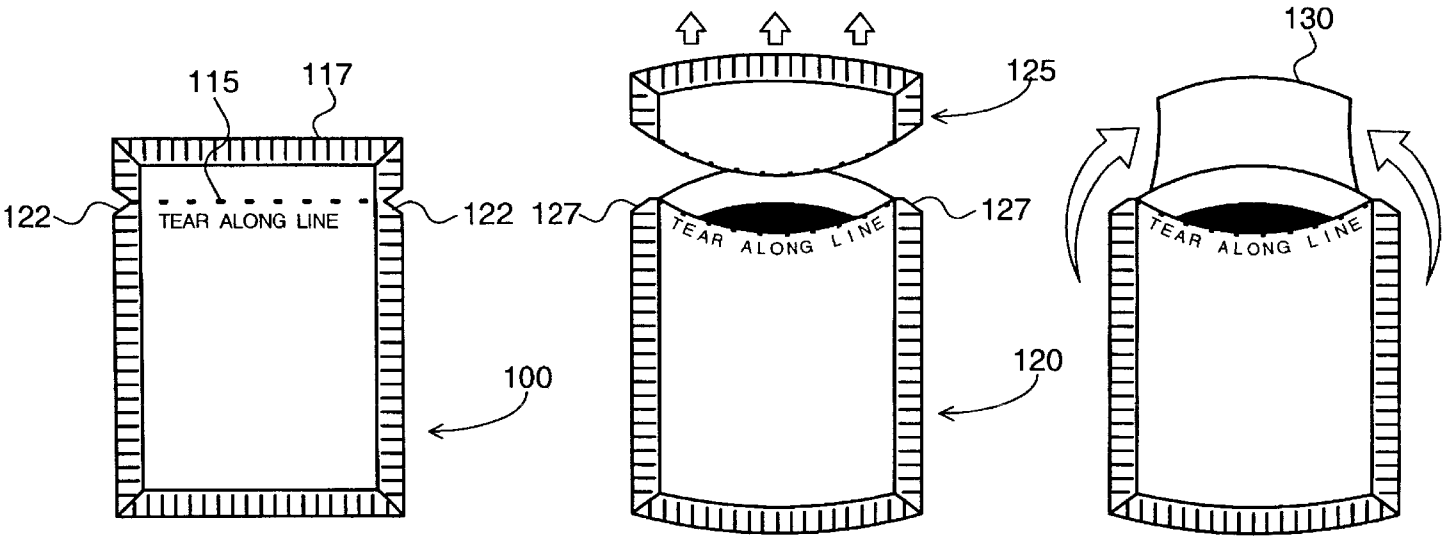
100
117
115
122
TEAR ALONG LINE
122
FIGURE 1A
125
127
120
TEAR ALONG LINE
127
FIGURE 1B
130
TEAR ALONG LINE
FIGURE 1C
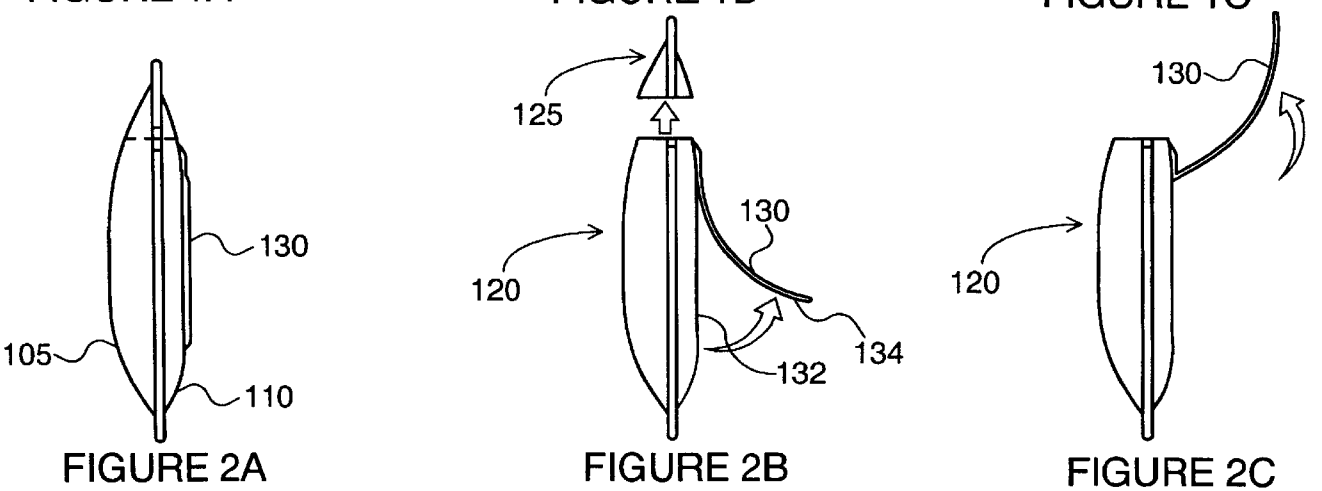
130
110
105
FIGURE 2A
125
130
134
132
120
FIGURE 2B
130
120
FIGURE 2C

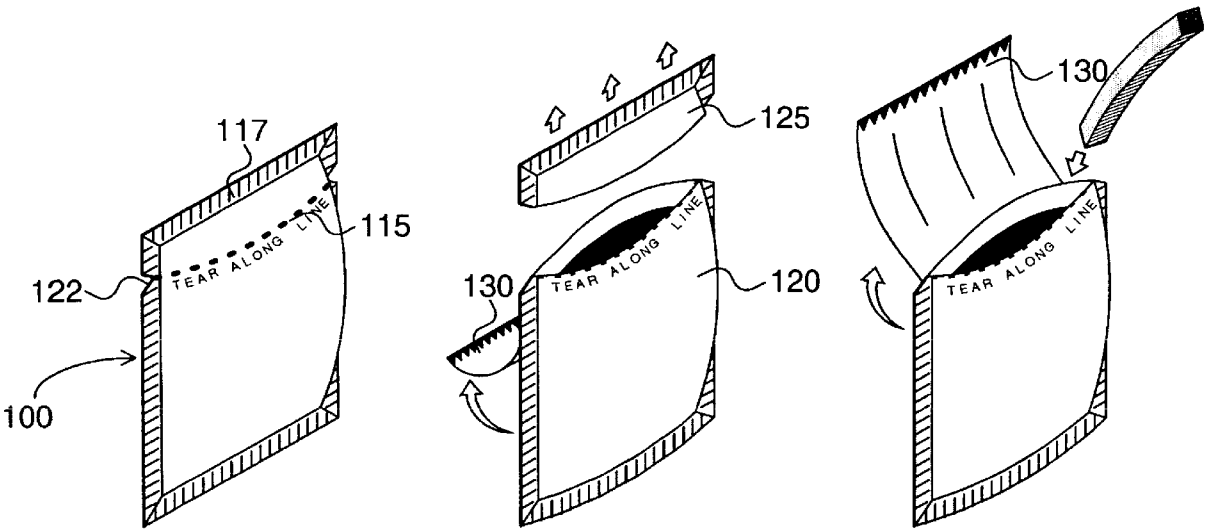
FIGURE 3A
FIGURE 3B
FIGURE 3C
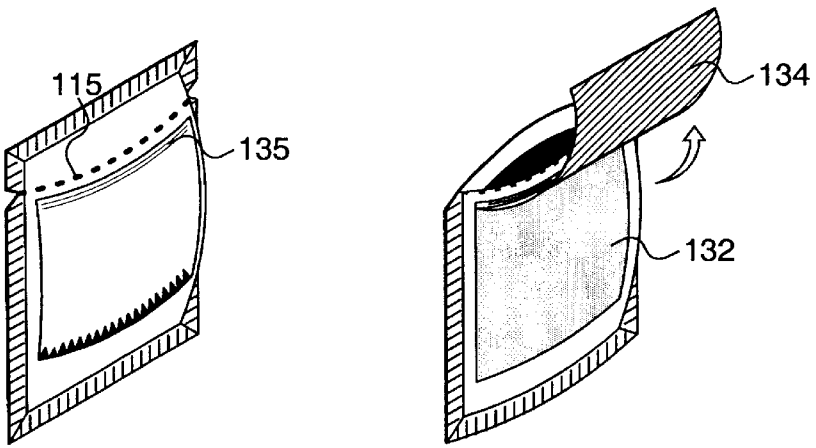
FIGURE 4A
FIGURE 4B

CONDIMENT CONTAINER FOR ATTACHING TO OTHER OBJECTS

BACKGROUND OF THE INVENTION

Many people today consume fast foods and snacks in their cars. In such circumstances, people often find it difficult to spice up their food with condiments without making a mess. For instance, vehicle occupants typically find it difficult to eat french fries with ketchup in their vehicles, because they lack the room to spread out the fries and dip them in ketchup. This is especially so in today's smaller, fuel-efficient cars which tend to have less space between the driver and passenger seats.

Hence, vehicle occupants typically squirt the condiment (e.g., ketchup) on top of the food (e.g., fries) while the food is still in its container. This does not spread the condiment evenly, and often results in messy fingers and hands because the consumer has to grab the food by the end that is covered with the condiment. The food that is covered with the condiment can also spill, and this causes a mess in the car and on the consumer's clothes.

Vehicle occupants can also squirt the condiment on a detached surface, such as a spare piece of paper or wrapping. But, in this situation, the condiment is in jeopardy of creating a messy spill (e.g., creating a spill due to sudden deceleration or movement of the vehicle). Box-type packages (such as those used for containing sweet & sour, honey mustard, barbecue, or ranch dip) can be similarly unstable if they are not affixed to a surface.

Each of these problems can also serve to distract the driver and thereby lead to an accident. Moreover, these problems are more serious for the driver, who has at most one hand to manage the food and the condiments. Some drivers at times attempt to hold an open condiment package against the steering wheel with the one hand, while dipping food items with the other hand. This all-too-common practice severely impedes the driver's ability to steer the vehicle and can cause a spill.

Because of these problems, vehicle drivers and passengers often reluctantly avoid using condiments or avoid ordering food that they prefer to eat with condiments. To address this need, rigid special-purpose apparatuses (such as the devices disclosed in U.S. Pat. 5,667,119) have been proposed. These apparatuses attach to the car to hold the food and condiments. It would be impractical, however, for food vendors to distribute such apparatuses with each sale due to their material cost. In addition, these apparatuses would probably need to be attached to a window (because it is unlikely that consumers would permanently attach the apparatus in another location of their vehicles); however, such an attachment would block the driver's vision.

Also, if the apparatus protrudes into the passenger compartment, the apparatus might injure the occupants of the vehicle in the event of an accident. Federal regulations (promulgated by the National Highway and Traffic Safety Administration) require specific interior padding, prohibit sharp angles, and otherwise restrict the shape and contour of interior appointments, in order to prevent injuries. See, e.g., 49 CFR § 571.201.

Some have also proposed food containers with attached condiment containers (see, e.g., U.S. Pat. No. 5,429,262). However, such a solution would require that the consumer maintain the food container in a constant upright position to prevent the condiment from spilling. Keeping the food container in an upright position while driving is not always possible. This is especially so if the condiment container makes the food container unstable. Such a device might also require a new type of food container.

At present, there is no practical disposable condiment package that the fast food vendors can distribute to avoid these problems. The invention provides a portable condiment container that solves the problems faced by vehicle occupants who wish to eat while they are in their vehicles. The invention also provides a feasible solution for easily attaching condiments to a variety of surfaces, such as vertical, horizontal, slanting, curved, angled or other surfaces.

SUMMARY OF THE INVENTION

The invention is a condiment container that can attach to other objects. As used in this document, condiment means any seasoning or sauce that is used to enhance the flavor of any food or snack. Examples of condiments include ketchup, mustard, mayonnaise, soy sauce, ranch dressing, vegetable dip, salsa, barbecue sauce, teriyaki sauce, sweet-n-sour sauce, chocolate fudge, etc.

In one embodiment of the invention, the condiment container is a portable and disposable container that adhesively attaches to the interior of a vehicle. This embodiment facilitates the eating of food and snacks while driving. In this embodiment, the container has a sealed container body that stores a condiment. This container body can have any shape (e.g., it can be a packet or a bucket). A consumer can unseal the container body and expose the condiment stored in it.

This embodiment also includes an attaching arm that rotatably couples to the container body. The arm has an adhesive material on one of its sides. A consumer can attach the container to a surface in the vehicle by rotating the arm away from the container body and abutting the adhesive side of the arm to the vehicle surface.

BRIEF DESCRIPTION OF THE DRAWINGS

The novel features of the invention are set forth in the appended claims. However, for purpose of explanation, several embodiment of the invention are set forth in the following figures.

FIGS. 1A–1C present frontal views of one embodiment of the invention.

FIGS. 2A–2C present side views of the embodiment set forth in FIGS. 1A–1C.

FIGS. 3A–3C present perspective views of the front side of the embodiment set forth in FIGS. 1A–1C.

FIGS. 4A–4B present perspective views of the backside of the embodiment set forth in FIGS. 1A–1C.

DETAILED DESCRIPTION OF THE INVENTION

Figure 5A:
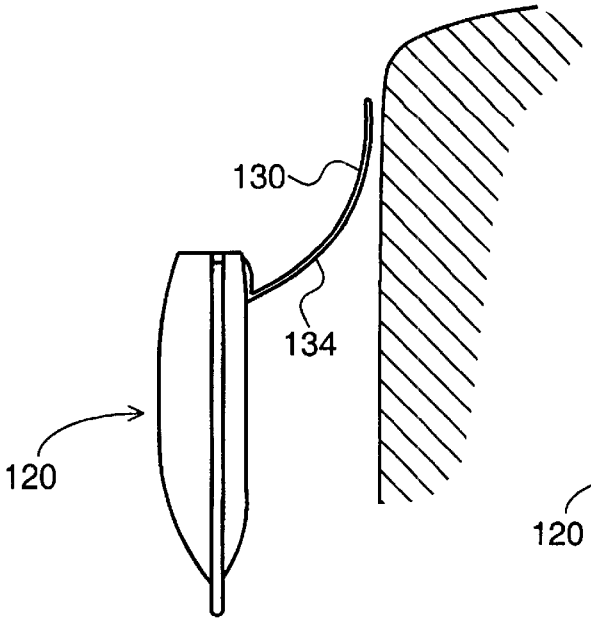
FIGS. 5A–5C demonstrate the attachment of one embodiment of the invention to the interior of a vehicle.

The invention is a condiment container that can be attached to other objects. As used in this document, condiment means any seasoning or sauce that is used to enhance the flavor of any food or snack. Examples of condiments include ketchup, mustard, mayonnaise, soy sauce, ranch dressing, vegetable dip, salsa, barbecue sauce, teriyaki sauce, sweet-n-sour sauce, chocolate fudge, etc. In the following description, numerous details are set forth for purpose of explanation. However, one of ordinary skill in the art would realize that the invention might be practiced without the use of these specific details.

One embodiment of the invention is a portable and disposable condiment container that adhesively attaches to the interior of a vehicle. This embodiment facilitates the eating of food and snacks while driving. This embodiment includes a container body that holds the condiment. The container body can have any shape. For instance, the container body can be in shape of a packet as discussed below by reference to FIGS. 1–5, or in shape of a bucket as discussed below by reference to FIGS. 6 and 7. Alternatively, the container body can have any multi-surface geometrical shape (e.g., any polyhedron with two or more exterior surfaces or sides).

The container body is sealed by a sealing-member (e.g., a lid or top) in order to keep the condiment in the container body. The sealing member partially or completely detaches from the container body to expose the condiment contained in the container body.

The container also includes an attaching arm that has an adhesive material on one of its sides. One end of this arm rigidly connects to the container body. In some embodiments of the invention, the arm is able to rotate about its rigid connection to the container body because it is made of a flexible bendable material. In these embodiments, the arm rotates away from the container body by bending away from the container body while its connected end stays rigidly attached to the container body. The arm can also rotate about its rigid connection when the rigid connection is flexible. Other pivoting structures can also be used to connect the arm rigidly and yet pivotally to the container body.

A more detailed embodiment of the invention will now be described by reference to FIGS. 1–5. This embodiment is a packet-type condiment container. Packet 100 is originally formed by two strips of plastic which form the front side 105 and backside 110 of the packet, as shown in FIG. 2A. These strips are sealed together at their outer periphery 117. Initially, three sides of these strips are sealed together and the condiment is poured into the pocket created by the three sealed sides. The fourth side of each of these strips are then sealed together, in order to enclose the condiment in the packet. A crimping, gluing, and/or heating mechanism is used to seal together the outer periphery of the strips.

In alternative embodiments of the invention, packet 100 is manufactured as a tube, with two long strips of plastic sealed along the vertical edges. This tube is then filled with the condiment all the way through, after which it is sealed (e.g., crimped sealed) into many packet units 100 at once.

Packet 100 can be detached into two parts along a dotted line 115. These two parts are the container body 120 and the sealing top 125. As shown in FIGS. 1B, 2B, and 3B, the sealing top 125 can be torn from the container body 120 by pulling the top away from the container body along dotted line 115. To facilitate the tearing of the sealing top 125, packet 100 is notched at the locations 122 where the dotted line reaches the sealed outer periphery of the two plastic sides 105 and 110. The dotted line can also be perforated to facilitate the tearing of the sealing top 125.

A consumer can detach the sealing top 125 from the container body 120 to expose the condiment held inside of container body 120. As shown in FIG. 1B, a consumer can enlarge the dipping orifice of the container by squeezing the sides 127 of the container.

Figure 5B:
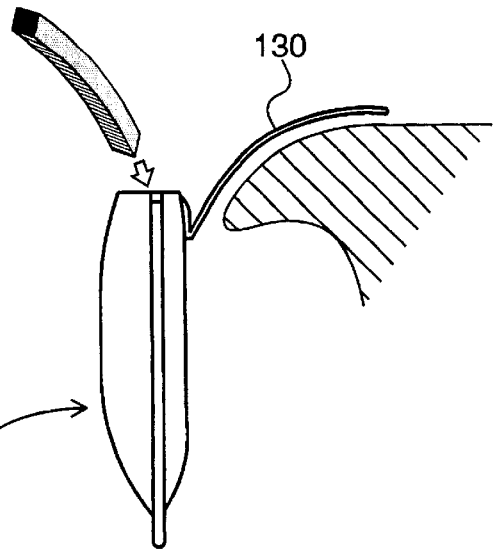

Some embodiments of packet 100 differ from conventional condiment packets. These embodiments are shallower and wider than conventional packets, and these embodiments open completely across their top to allow for direct dipping of the food or snack (e.g., direct dipping of a french fry as shown in FIGS. 3C and 5B) in the container body 120. In some embodiments of the invention, the backside 110 of the packet 100 is designed to have a smaller surface area than the front side 105 of the packet, and this allows the backside to lie flat while its front side 105 bulges outward.

As shown in FIGS. 2A–2C, packet 100 also includes an attaching arm 130. In this embodiment, the attaching arm is a rectangular strip of flexible plastic material. In other embodiments, the attaching arm has different shapes and/or is made of different materials. For instance, some embodiments have an attaching arm made of paper.

The packet 100 is manufactured with the attaching arm 130 uniformly abutting one of the sides (e.g., the backside) of the packet. FIG. 2A presents a side view of the packet 100 with the arm in such a retracted position.

Any number of manufacturing techniques could be used to manufacture the arm in this position. For instance, as shown in FIG. 4A, the top of the attaching arm is rigidly affixed to the backside of the packet along a seam 135. The top of the arm can be so affixed by using an adhesive, heating, and/or crimping technique. In some embodiments, this rigid attachment is permanent while in others it is not.

As shown in FIG. 4B, the remainder of the attaching arm uniformly and detachably affixes to the backside of the packet. To make this detachable connection, an adhesive material is used. This adhesive material is placed on the backside 134 of the attaching arm or the backside 132 of the packet, or both. As discussed below, this adhesive material on the backside 134 of the arm 130 will also allow the arm to attach to other surfaces once the arm partially detaches from the backside 132 of the packet 100. Attaching arm 130 also serves as an adhesive covering member in the embodiments where this arm abuts the container body to cover the adhesive material on its backside.

In some embodiments of the invention, one of the following glues from the National Starch & Chemical Company is used as the adhesive material: NACOR 4536, NACOR 4537, NACOR 4554. Other embodiments use other glues, gels, or other adhesive materials which, like the NACOR adhesives, (1) are strong enough to secure the container to any leather, plastic or glass surface under normal temperatures, (2) are easily removable, and (3) leave little or no adhesive residue on surfaces that they contact. In some embodiments of the invention, the strength of the adhesive material is approximately 1 oz/square inch of adhesive surface area, and this material can secure the container to any leather, plastic or glass surface in a temperature range from 0–50 degrees Celsius.

Although one manner of manufacturing packet 100 with the attaching arm 130 is explained above, one of ordinary skill will understand that other manufacturing processes could be used to manufacture this packet with the attaching arm. In some embodiments, the adhesive material on the arm for attaching the arm to other objects is not also used for detachably affixing the arm to the backside of the container body. These embodiments use alternative techniques for detachably affixing the arm to the container body.

A consumer can place the attaching arm in an extended position when the consumer wishes to attach the packet to another object. Specifically, as shown in FIGS. 2B–2C, 3B–3C, and 4B, a consumer can partially detach the attaching arm 130 from the container body 120 by peeling the bottom side of the arm away from the container body while the top side of the arm stays rigidly attached to the backside of the container body 120. By so detaching the arm, the consumer can rotate the arm away from the container body and into a variety of extended position.

In the embodiments that use a flexible bendable material for arm 130, the arm rotates away from the container body by bending away from the container body while its top side stays rigidly connected to the backside of container body 120. The container body 120 is also flexible in some embodiments and this flexibility allows the arm rotate about its rigid connection with the container body. Other pivoting structures can also be used to rigidly and yet rotatably connect the arm 130 to the container body 120.

Also, once the attaching arm 130 partially detaches from the backside of the packet 100, it reveals the adhesive material on its backside 134. The adhesive material can also reside on the backside 132 of the packet 100. The adhesive material on the backside of the attaching arm and/or packet, in turn, will allow the consumer to attach the extended arm to another object.

Figure 5C:
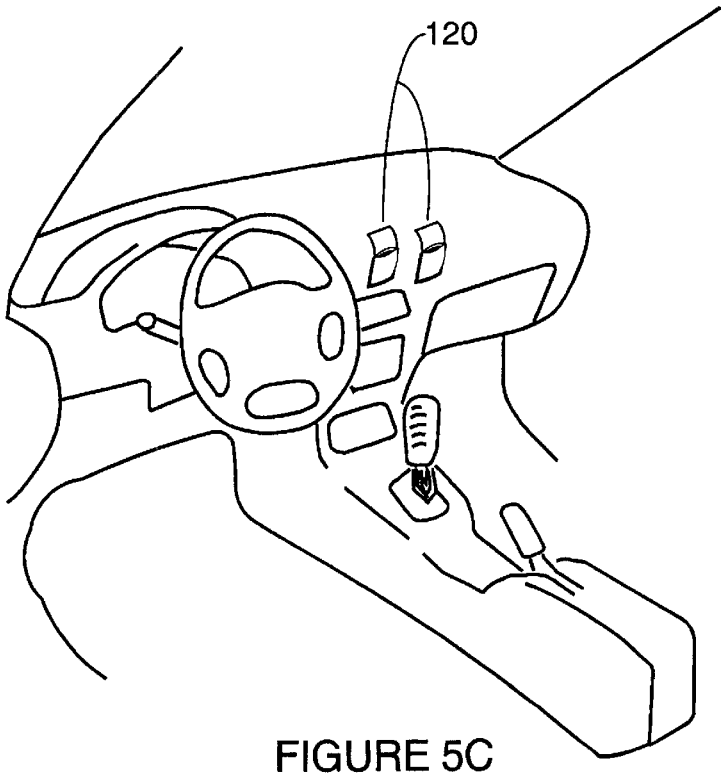

For instance, as shown in FIG. 5C, the adhesive material will allow the consumer to attach the packet to the dashboard of the vehicle. In addition, since the attaching arm 130 can assume a variety of extended positions, it can attach packet 100 to a variety of surfaces, such as vertical, horizontal, slanted or angled surfaces, as shown in FIGS. 5A and 5B. The attaching arm can also attach to a variety of curved and/or uneven surfaces when a flexible material (e.g., a flexible plastic) is used for the arm.

As shown in FIGS. 1C and 3C, the attaching arm 130 is as wide as the dipping orifice of container body 120, in some embodiments of the invention. This width of the attaching arm prevents the condiment contained in the container from spilling onto the object (e.g., the dashboard) abutting the container.

Figure 6A:
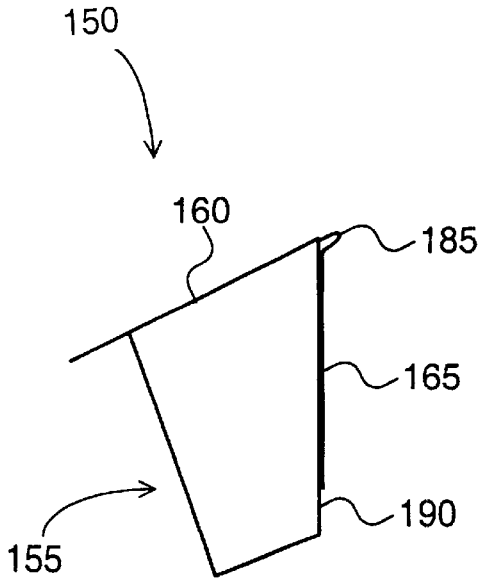
FIGS. 6A–6C present another embodiment of the invention.
Figure 6B:
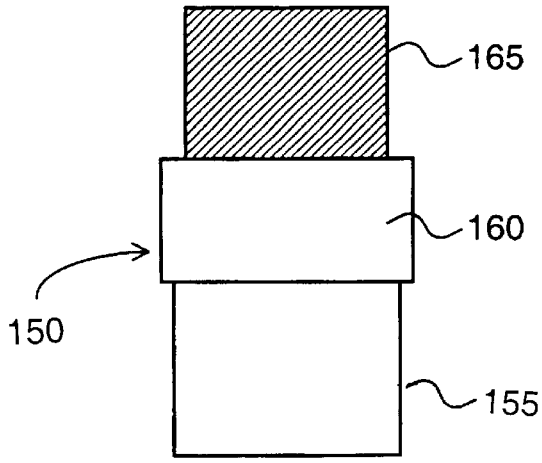
Figure 6C:
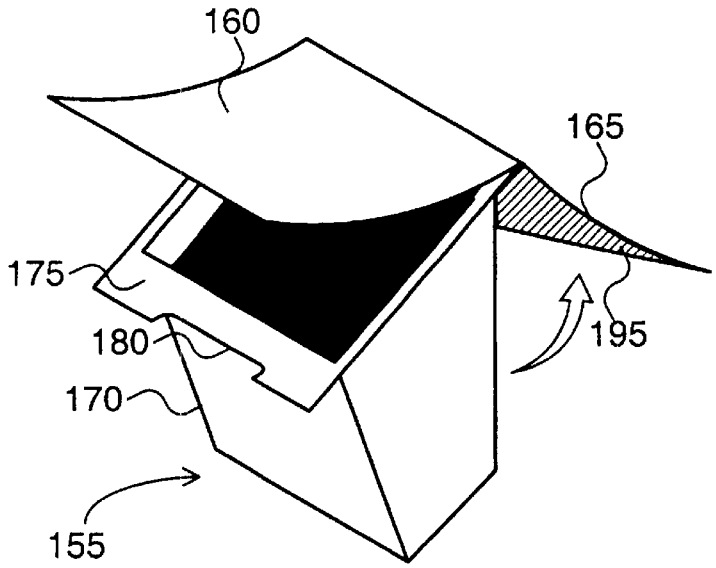

Other embodiments of the invention are containers that are polyhedrons (i.e., are three-dimensional geometric bodies formed by a union of two or more polygonal surfaces or sides). FIGS. 6A–6C present one such embodiment. This embodiment is a bucket-type condiment container 150.

Container 150 has the following three parts: a container body 155, a covering lid 160, and an attaching arm 165. The container body 155 includes (1) a bucket or reservoir 170 that stores a condiment, and (2) a lip 175 that surrounds the bucket. In some embodiments of the invention, the container body 155 is made of plastic and it is formed by an injection molding process.

The covering lid 160 is sealed to the lip 175 to keep the condiment in the container. As shown in FIG. 6C, a consumer can partially or completely detach the covering lid 160 from the container to expose the condiment stored in the bucket 170. In some embodiments of the invention, the lip 175 has a notch 180 to facilitate the tearing of the covering lid 160 from the bucket 170.

The container 150 also includes the attaching arm 165 for allowing a consumer to attach adhesively the container to another object. In some embodiments, the attaching arm is a rectangular strip of flexible plastic material. In other embodiments, this attaching arm has different shapes and/or is made of different materials. For instance, some embodiments have an attaching arm made of paper.

One end of the attaching arm rigidly affixes to the container body 155. As discussed below, this end can rigidly affix to the backside of the bucket 170 or the lip 175. In the embodiment depicted in FIGS. 6A–6C, the top end 185 of the arm 165 rigidly attaches to the lip 175, while the remainder of the attaching arm uniformly and detachably affixes to the backside of the bucket.

In some embodiments of the invention, the attaching arm is formed as an integral part of the lip 175 during the injection molding of the container body 155. In alternative embodiments, the top of the attaching arm is attached to the container body by a heating, crimping, or adhesive-attachment technique. For instance, in some embodiments of the invention, the top of the attaching arm rigidly affixes to the backside 190 of the bucket along a seam, by using an adhesive, heating, or crimping mechanism. The rigid attachment of the arm 165 to the container body 155 is permanent in some embodiment, while it is not permanent in other embodiments.

As mentioned above and as shown in FIG. 6A, some embodiments of container 150 are manufactured so that the remainder of the attaching arm uniformly and detachably affixes to the backside of the bucket. To make this detachable connection, an adhesive material is used in some embodiments. This adhesive material is placed on the backside 195 of the attaching arm or the backside 190 of the bucket, or both. As discussed below, this adhesive material on the backside of the arm 165 will also allow the arm to attach to other surfaces once the arm partially detaches from the backside 190 of the bucket 170. The attaching arm 165 also serves as an adhesive covering member in the embodiments where this arm abuts the container body to cover the adhesive material on its backside.

Some embodiments of the invention use one of the following glues from the National Starch & Chemical Company as the adhesive material: NACOR 4536, NACOR 4537, NACOR 4554. Other embodiments use other glues, gels, or other adhesive materials which, like the NACOR adhesives, (1) are strong enough to secure the container to any leather, plastic or glass surface under normal temperatures, (2) are easily removable, and (3) leave little or no adhesive residue on surfaces that they contact. In some embodiments of the invention, the strength of the adhesive material is approximately 1 oz/square inch of adhesive surface area, and this material can secure the container to any leather, plastic or glass surface in a temperature range from 0–50 degrees Celsius.

Several methods for manufacturing container 150 are described above. One of ordinary skill, however, will understand that other manufacturing processes could be used to manufacture this container. For instance, in some embodiments, the adhesive material on the arm for attaching the arm to other objects is not also used for detachably affixing the arm to the backside of the container body. These embodiments use alternative techniques for detachably affixing the arm to the container body.

As shown in FIG. 6C, a consumer can partially detach the attaching arm 165 from the container body 155 when the consumer wishes to attach the container 150 to another object. To detach partially the arm from the container body, the consumer peels the bottom side of the arm away from the container body while the top side of the arm stays rigidly attached to the lip 175. By so detaching the arm, the consumer can rotate the arm away from the container body and into an extended position.

In some embodiments of container 150, the arm 165 is made of a flexible bendable material. In these embodiments, the arm rotates away from container body 155 by bending away from the container body while its top side stays rigidly connected to lip 175. Also, in some embodiments, the rigid connection between the arm's top side and the lip 175 is flexible to allow the arm to rotate about its rigid connection. Other pivoting structures can also be used to connect the arm 165 rigidly and yet pivotally to the container body 155.

Once the attaching arm 165 partially detaches from the backside 190 of the bucket 170, it reveals the adhesive material on its backside 195. The adhesive material can also reside on the backside 190 of the bucket 170. The adhesive material on the backside of the attaching arm and/or bucket, in turn, will allow the consumer to attach the container 150 to another object. For instance, the adhesive material will allow the consumer to attach container 150 to the dashboard of a vehicle, in much the same fashion as shown as in FIG. 5C for the packet 100.

A consumer can place the arm in a variety of retracted and extended positions because the arm can rotate about the axis defined by its rigid attachment. The arm can take a retracted position so that it does not unnecessarily protrude from the container body when the arm is not being used. One such retracted position is the manufactured position of arm 165, which is described above with reference to FIG. 6A.

The pivoting action of the arm also allows the arm to take a variety of extended positions. This ability, in turn, allows the arm to attach container 150 to a variety of surfaces (such as vertical, horizontal, slanted or angled surfaces), in much the same fashion as shown in FIGS. 5A and 5B for packet 100. The arm can also attach to a variety of curved and/or uneven surfaces when the arm is made of a flexible material (e.g., a flexible plastic).

Figure 7A:
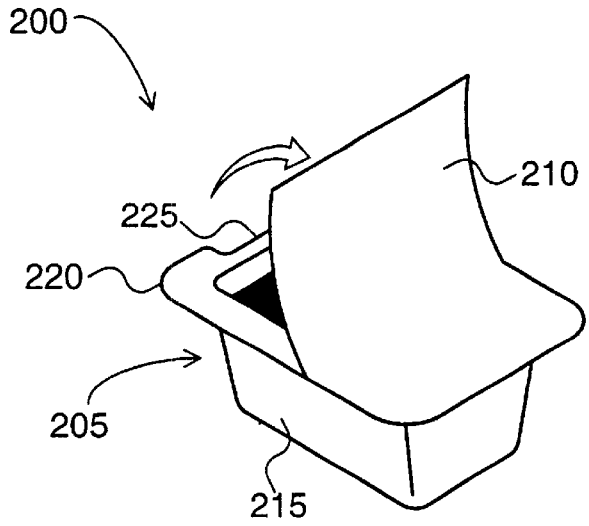
FIGS. 7A–7C present yet another embodiment of the invention.
Figure 7B:
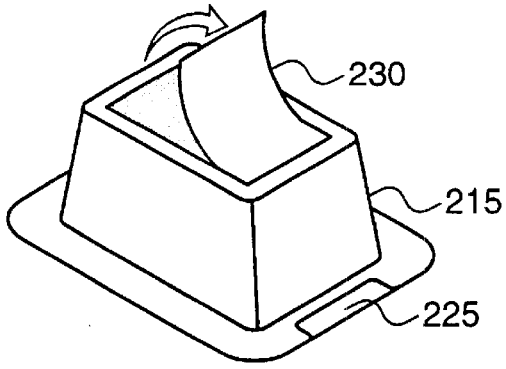
Figure 7C:
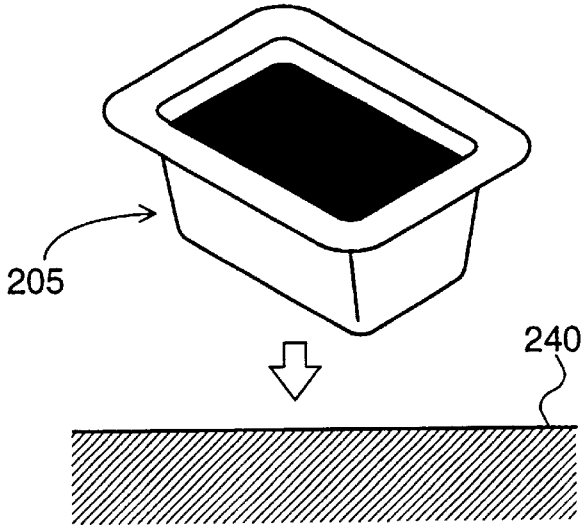

FIGS. 7A–7C present yet another embodiment of the invention. The condiment container 200 of this embodiment is in shape of a bucket. This container 200 has two detachable parts, which are a container body 205 and a covering lid 210.

The container body 205 includes a bucket or reservoir 215 for storing a condiment and a lip 220 for surrounding the bucket. In some embodiments of the invention, this bucket is made of plastic and it is formed by an injection molding process. The covering lid 210 is sealed to the lip to keep the condiment in the container. As shown in FIG. 7A, a consumer can partially or completely detach the covering lid 210 from the container to expose the condiment stored in the container. As shown in FIGS. 7A and 7B, the bucket 215 has a notch on its top at a location 225 that abuts covering lid 210. This notch facilitates the tearing of the sealing cover 210 from the lip 220.

Unlike container 150, this container 200 does not have an attaching arm. It only includes an adhesive-covering member 230. In this embodiment, the covering member is a rectangular strip of plastic material. In other embodiments, this covering member has different shapes and/or is made of different materials. For instance, the covering member can also be made of paper or foil.

Before a consumer uses container 200, the covering member abuts one of the sides (e.g., the bottom) of the container bucket 215. As shown in FIG. 7B, in one embodiment of the invention, a consumer can completely detach the covering member 230 from the container bucket 215 by peeling the strip from the container body. In other embodiments of the invention, however, the covering member only partially detaches from the container bucket 215. As shown in FIG. 7C, after the covering member has been removed, a consumer can attach container body 210 to another object 240 (e.g., the dashboard of a vehicle) by pressing the bottom side of the bucket on a horizontal surface of the object.

One of ordinary skill in the art will realize that the invention will change the way occupants of vehicles can consume food and snacks in their vehicles. The invention allows vehicle occupants to easily attach condiment containers to readily accessible locations in their vehicles (e.g., the dashboard), and thereby facilitates the dipping of food and snacks in the condiment container.

While the invention has been described with reference to numerous specific details, one of ordinary skill in the art will recognize that the invention can be embodied in other specific forms without departing from the spirit of the invention. For instance, the attaching arms 130 and 165 have been described as uniformly abutting one of the sides (e.g., the backside) of container bodies 120 and 155. One of skill in the art will realize that the invention's condiment container does not need to be manufactured with the attaching arm uniformly abutting one of the sides of the container. The attaching arms 130 and 165 are simply so manufactured in order to create smooth, uniform shapes for containers 100 and 150, which, in turn, simplify the distribution of these containers.

In other embodiments of the invention, the attaching arm only substantially uniformly abuts one side of the condiment container prior to its use by the consumer. In other embodiments, the only portion of the arm that attaches to the container body is its side (e.g., its top side) that rigidly attaches to the container body; the remainder of the arm neither rigidly nor detachably abuts the container body. These embodiments, however, include an adhesive-covering member (e.g., a piece of foil) for covering the adhesive on the backside of attaching arm, which no longer abuts the backside of the container to cover the adhesive material.

In addition, other packet-type embodiments of the invention do not have attaching arms. These embodiments simply have adhesive material on an exterior surface of the packet (e.g., the backside of the packet), and an adhesive-covering member for covering the adhesive material. When the consumer wishes to attach these embodiments to another object, the consumer removes the adhesive covering material, and presses the adhesive side of the packet to the other object. Thus, one of ordinary skill in the art will understand that the invention is not to be limited by the foregoing illustrative details, but rather is to be defined by the appended claims.

I claim:

1. A condiment container comprising:

a packet formed by at least two sheets of a material, wherein the two sheets are sealed together;

condiment stored in the packet;

an attaching arm rotatably attached to the packet;

an adhesive material on a first side of the attaching arm;

wherein the arm adhesively attaches the packet to another object when it rotates away from the packet and the arm's first side abuts the object.

2. The condiment container of claim 1, wherein the object is an interior surface of a vehicle.

3. The condiment container of claim 1, wherein the first side of the arm initially abuts the packet.

4. The condiment container of claim 1, wherein the attaching arm has first and second ends and assumes one of a retracted position and an extended position with respect to the packet, wherein the first end of the attaching arm rigidly affixes to the packet and the second end of the attaching arm detachably affixes to the packet, wherein the first side of the attaching arm abuts the packet when the arm is in the retracted position, wherein to place the arm in the extended position to expose the adhesive material on the first side to attach the container to another object, the second end detaches from the packet and the arm rotates away from the packet.

5. A condiment container comprising:

a. a container body that has two sides that are sealed around their periphery to form a packet;

b. condiment stored in the container body;

c. an attaching arm having a first side and first and second ends, wherein the arm's first side abuts the container body, wherein the first end rigidly affixes to the container body while the second end detachably affixes to the container body;

d. an adhesive material on the arm's first side;

e. wherein the arm attaches the container to another object when the arm's second end detaches from the container body, the arm rotates away from the container body to expose the adhesive material on the first side, and the arm's first side abuts the object.

6. The condiment container of claim 5, wherein the object is an interior surface of a vehicle.

7. The condiment container of claim 5 further comprising a sealing member, said sealing member sealing the container body to keep the condiments in the container, wherein said sealing member is detachable from the container to expose the condiment stored in the container.

8. The condiment container of claim 7, wherein the sealing member is a top of the packet, wherein the top of the packet detaches to expose an open side of the packet, said open side allowing the condiment stored in the container body to be accessed while the arm adhesively attaches the container to the other object.

* * * * *